US012005314B2

(12) United States Patent
Allen

(10) Patent No.: US 12,005,314 B2
(45) Date of Patent: Jun. 11, 2024

(54) EXERCISE DEVICE FOR INCLINE PUSH-UPS

(71) Applicant: Robert C. Allen, Baltimore, MD (US)

(72) Inventor: Robert C. Allen, Baltimore, MD (US)

( * ) Notice: Subject to any disclaimer, the term of this patent is extended or adjusted under 35 U.S.C. 154(b) by 188 days.

(21) Appl. No.: 17/582,075

(22) Filed: Jan. 24, 2022

(65) Prior Publication Data

US 2022/0233915 A1 Jul. 28, 2022

Related U.S. Application Data

(63) Continuation-in-part of application No. 29/767,696, filed on Jan. 25, 2021, now Pat. No. Des. 986,358.

(51) Int. Cl.

| | |
|---|---|
| ***A63B 23/12*** | (2006.01) |
| ***A63B 21/00*** | (2006.01) |
| ***A63B 21/068*** | (2006.01) |
| ***A63B 24/00*** | (2006.01) |
| ***A63B 71/06*** | (2006.01) |

(52) U.S. Cl.

CPC .... *A63B 23/1236* (2013.01); *A63B 21/00047* (2013.01); *A63B 21/068* (2013.01); *A63B 21/4035* (2015.10); *A63B 24/0062* (2013.01); *A63B 71/0622* (2013.01); *A63B 2220/17* (2013.01); *A63B 2230/06* (2013.01)

(58) Field of Classification Search

None

See application file for complete search history.

(56) References Cited

U.S. PATENT DOCUMENTS

| | | | | | |
|---|---|---|---|---|---|
| 1,282,489 | A | * | 10/1918 | Strodel | A47B 19/06 248/447.2 |
| 3,106,376 | A | * | 10/1963 | Scott | A47B 27/00 248/447.2 |
| 3,746,295 | A | * | 7/1973 | Stepanek | A47F 5/0068 248/447.2 |
| 5,181,897 | A | * | 1/1993 | Agan | A63B 21/4035 482/141 |
| D332,981 | S | * | 2/1993 | Poli | D21/686 |
| 5,226,868 | A | * | 7/1993 | Montgomery | A63B 21/4035 482/141 |
| D354,100 | S | * | 1/1995 | Tsay | D21/686 |
| 5,466,206 | A | * | 11/1995 | Fleming | A63B 21/4035 482/141 |

(Continued)

FOREIGN PATENT DOCUMENTS

| | | | | |
|---|---|---|---|---|
| CA | 1126237 A | * | 6/1982 | A47B 97/00 |
| CN | 201969279 U | * | 9/2011 | |

(Continued)

*Primary Examiner* — Shila Jalalzadeh Abyaneh

(74) *Attorney, Agent, or Firm* — Nadya Reingand

(57) ABSTRACT

The present disclosure relates to an exercise device for incline push-ups that allows a user to do incline push-up exercises in a comfortable and efficient (in terms of the load exerted on upper body muscles) manner. More specifically, the exercise device comprises a push-up board removably attached to an edge of a worktop by using a support structure. When engaged with the edge of the worktop, the support structure is configured to support the board at an acute angle to the worktop. The exercise device thus configured may be particularly suitable for users who are in a recovery phase after a surgery or after an injury (e.g., a shoulder injury).

14 Claims, 8 Drawing Sheets

(56) References Cited

U.S. PATENT DOCUMENTS

D371,462 S * 7/1996 Grossmith ..... D6/349
D374,045 S * 9/1996 Ward, III ..... D21/686
5,718,622 A * 2/1998 Jones ..... B24D 15/04 451/523
5,749,818 A * 5/1998 Sather ..... A63B 21/00047 482/141
6,000,663 A * 12/1999 Plasse ..... A01G 5/02 248/447
D629,852 S * 12/2010 Repac ..... D21/662
8,475,343 B2 * 7/2013 Hinds ..... A63B 23/12 482/141
8,905,905 B2 * 12/2014 Mangalindan ..... A63B 23/1236 482/141
2006/0035771 A1 * 2/2006 Gant ..... A63B 21/4035 482/141
2007/0131149 A1 * 6/2007 Mayben ..... A47B 57/00 108/97
2009/0286660 A1 * 11/2009 Nicklas ..... A63B 21/00181 482/121
2012/0028764 A1 * 2/2012 Miller ..... A63B 23/14 482/44
2012/0210914 A1 * 8/2012 Hamilton ..... A47B 21/0314 108/50.11
2015/0005145 A1 * 1/2015 Zovich ..... A63B 21/4037 482/141
2015/0208800 A1 * 7/2015 Yang ..... A61F 5/00 297/488
2018/0169468 A1 * 6/2018 Barrie, III ..... A63B 21/4035
2020/0094102 A1 * 3/2020 McRann ..... A63B 21/169
2021/0121732 A1 * 4/2021 Cotton ..... A63B 23/1236
2021/0178216 A1 * 6/2021 Ducato ..... A63B 23/1236
2022/0054890 A1 * 2/2022 Owusu ..... A63B 71/0622

FOREIGN PATENT DOCUMENTS

CN 202270305 U * 6/2012
CN 202506059 U * 10/2012
CN 102886119 A * 1/2013
CN 203540013 U * 4/2014
CN 104722033 A * 6/2015
CN 104722034 A * 6/2015
CN 205796399 U * 12/2016
FR 2949347 A1 * 3/2011 ..... A63B 21/4039
JP 2008183338 A * 8/2008
JP 2015020052 A * 2/2015
KR 200456662 Y1 * 11/2011
KR 20120124849 A * 11/2012
KR 20180018191 A * 2/2018
KR 102031878 B1 * 11/2019
KR 20200032501 A * 3/2020

* cited by examiner

EXERCISE DEVICE FOR INCLINE PUSH-UPS

CROSS REFERENCE TO RELATED APPLICATIONS

The present application is a Continuation-in-part of the U.S. Design Pat. application No. 29767696, filed with the US Patent and Trademark Office on 25 Jan. 2021, entitled "EXERCISE BOARD FOR PUSH-UPS", the entire disclosure of which is incorporated herein by reference.

TECHNICAL FIELD

The present disclosure relates generally to the field of exercise equipment. In particular, the present disclosure relates to an exercise device for incline push-ups which can be mounted on an edge of a worktop.

BACKGROUND

The benefits of push-ups for upper body development are well-known. Push-ups are one of the best exercises for strengthening body muscles, especially the triceps, pectorals, and deltoids. Unlike weight training, push-ups can be done without a fitness coach and with less stress on body joints.

During push-up exercises, a user usually places hands directly underneath shoulders. Moreover, elbows are disposed at an almost right angle with upper arms disposed substantially parallel with the ground. As a result, a mass load displacement can be harsh for some users with weakened wrists, elbows, and joints, or for those users who have, for example, shoulder, arm, collarbone injuries. All of this can ultimately make the push-up exercises counterproductive and, at the same time, discourage the user from doing push-ups with a proper technique.

Another problem with doing such traditional push-ups is that they do not necessarily strengthen all the muscles in the user upper body. Since these push-ups are usually performed at the same angle, only a portion of the muscles in the user upper body are activated to raise and lower the user body during the push-up exercises.

In contrast, incline push-ups (e.g., those done by using a bench) work the user upper body but with less stress on shoulders, arms, and wrists than the traditional push-ups. This is because the incline push-ups allow for user legs to support a greater percentage of the user body weight. Therefore, the incline push-ups can be a great alternative for those users who struggle with upper-body injuries or joint problems.

However, the existing exercise devices for incline push-ups are often cumbersome, not easy to use, as well as do not always provide a reduced load on the upper body muscles. All of this may make such exercise devices unsuitable, for example, for beginners or anyone with a shoulder or other arm injury.

SUMMARY

This summary is provided to introduce a selection of concepts in a simplified form that are further described below in the detailed description. This summary is not intended to identify key features of the present disclosure, nor is it intended to be used to limit the scope of the present disclosure.

It is an objective of the present disclosure to provide a technical solution that allows a user to do incline push-ups in a comfortable and efficient (in terms of the load exerted on upper body muscles) manner.

The objective above is achieved by the features of the independent claim in the appended claims. Further embodiments and examples are apparent from the dependent claims, the detailed description, and the accompanying drawings.

According to an embodiment, an exercise device for incline push-ups is provided. The device comprises a board and a support structure. The board has a top surface and a bottom surface. The top surface is configured to receive at least one hand of a user. The support structure is attached to the bottom surface of the board. The support structure is configured to be engaged with an edge of a worktop (e.g., tabletop, countertop, etc.). The support structure is further configured, when engaged with the edge of the worktop, to support the board at an acute angle to the worktop. The exercise device thus configured allows the user to comfortably do incline push-up exercises with less resistance without having to get down on the floor either in the prone position or in the traditional push-up position. The exercise device may be particularly suitable for those users who are in a recovery phase after a surgery or after an injury (e.g., a shoulder injury).

In an additional embodiment, the support structure has a through groove that is shaped to match the edge of the worktop. The through groove runs relative to the board such that the board is at the acute angle to the worktop when the support structure is engaged with the edge of the worktop by means of the through groove. By using this configuration of the support structure, it is possible to provide the strong engagement or grip between the board and the edge of the worktop.

In an additional embodiment, the support structure comprises a first support bracket and a second support bracket. In this embodiment, the first support bracket and the second support bracket are shaped such that, when attached adjacent to each other on the bottom surface of the board, the first support bracket and the second support bracket form the through groove. This configuration of the support structure simplifies mounting and unmounting of the exercise device to and from the edge of the worktop, as well as makes the exercise device easy to transport (when the exercise device is in the unmounted state).

In an additional embodiment, the through groove has an inner surface at least partly coated with a rubber material. By using the rubber material, it is possible to improve the engagement between the exercise device and the edge of the worktop even more.

In an additional embodiment, the board has at least one recess made on the bottom surface, and the support structure comprises at least one folding bracket configured to be in a folded state and an unfolded state. In this embodiment, the at least one folding bracket is attached to the bottom surface of the board such that the at least one folding bracket is hidden in the recess in the folded state. Moreover, the at least one folding bracket comprises a clamping element configured to be engaged with the edge of the worktop when the at least one folding bracket is in the unfolded state. By using this configuration of the support structure, it is possible to provide the strong engagement or grip between the board and the edge of the worktop.

In an additional embodiment, each of the at least one folding bracket has a surface portion which is in contact with the edge of the worktop when the clamping element is engaged with the edge of the worktop. In this embodiment, the surface portion is at least partly coated with a rubber material. By using the rubber material, it is possible to improve the engagement between the exercise device and the edge of the worktop even more.

In an additional embodiment, the acute angle ranges from about 30 to about 70 degrees. Thus, the exercise device may allow the user to do the incline push-up exercises at different angles, thereby efficiently changing a mass load distribution, if required. The angle itself may be changed by replacing the support structure with another support structure providing a different inclined position for the board.

In an additional embodiment, the top surface of the board is coated with a foam cushion. The foam cushion eases pressure on the user hands, thereby preventing blister and callus development.

In an additional embodiment, the top surface of the board comprises a hand position marking. The hand position marking may guide the user on how to properly place his/her hands on the board, thereby leading to the correct execution of incline push-ups. The hand position marking may be especially useful for those new to the incline push-up exercises.

In an additional embodiment, the top surface of the board comprises at least two hand position markings each corresponding to a different hand position. In this embodiment, each of the at least two hand position markings is color-coded. The color-coded hand position markings may guide the user on how to place his/her hands on the board to work upper body muscles of interest (e.g., the pectorals). Again, the color-coded hand position markings may be especially useful for those new to the incline push-up exercises.

In an additional embodiment, the exercise device further comprises at least one sensor integrated in the board and a display installed on the top surface of the board. The at least one sensor is configured to collect push-up related information. The display is connected to the at least one sensor and configured to output the push-up related information to the user. By using the push-up related information, the user may monitor how he/she does the incline push-up exercises.

In an additional embodiment, the push-up related information comprises at least one of the following: a heart rate of the user during the incline push-up exercises, a number of incline push-ups done, calories burned during the incline push-up exercises, and a pace of incline push-ups. By analyzing these parameters, the user may understand whether he/she needs to make any change in his/her incline push-up exercises.

In an additional embodiment, the exercise device further comprises a processing unit installed in the board and connected to the at least one sensor. The processing unit is configured to generate a plan for everyday incline push-up exercises based on the push-up related information from the at least one sensor. By using such a plan, the user may efficiently develop his/her upper body muscles.

In an additional embodiment, each of the board and the support structure is made of wood or plastic. By using these materials, it is possible to simplify the device manufacture.

Other features and advantages of the present disclosure will be apparent upon reading the following detailed description and reviewing the accompanying drawings.

BRIEF DESCRIPTION OF THE DRAWINGS

The present disclosure is explained below with reference to the accompanying drawings in which.

DETAILED DESCRIPTION OF THE PREFERRED EMBODIMENTS

Figure 1A:
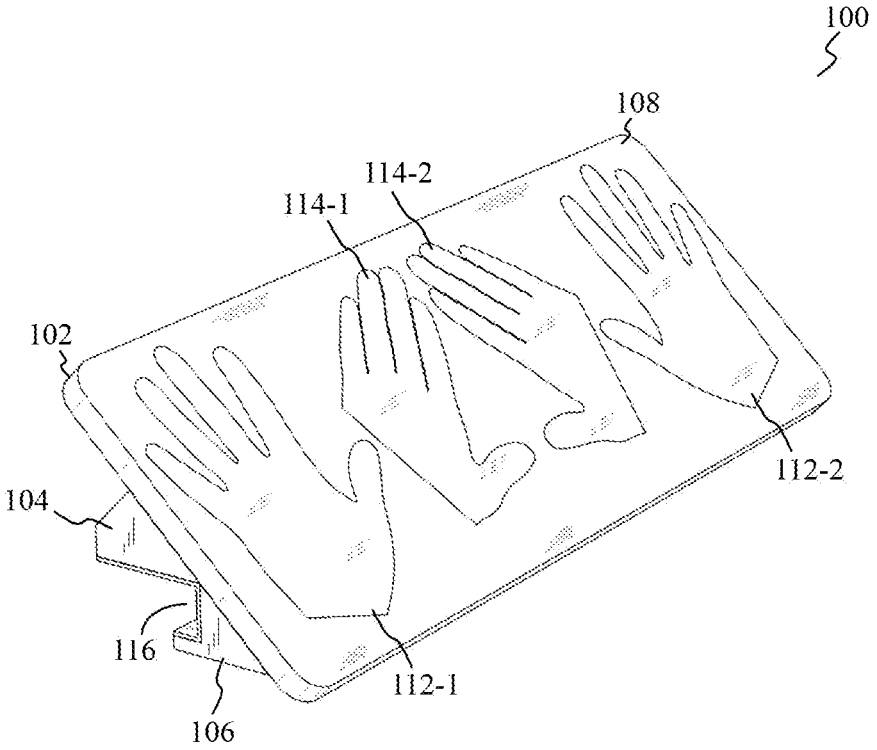
FIGS. 1A-1C show different views of an exercise device for incline push-ups in accordance with a first exemplary embodiment, namely: a front perspective view (FIG. 1A), a side view (FIG. 1B), and a bottom perspective view (FIG. 1C)

Various embodiments of the present disclosure are further described in more detail with reference to the accompanying drawings. However, the present disclosure may be embodied in many other forms and should not be construed as limited to any certain structure or function discussed in the following description. In contrast, these embodiments are provided to make the description of the present disclosure detailed and complete.

According to the detailed description, it will be apparent to the ones skilled in the art that the scope of the present disclosure encompasses any embodiment thereof, which is disclosed herein, irrespective of whether this embodiment is implemented independently or in concert with any other embodiment of the present disclosure. For example, the apparatus disclosed herein may be implemented in practice using any numbers of the embodiments provided herein. Furthermore, it should be understood that any embodiment of the present disclosure may be implemented using one or more of the elements presented in the appended claims.

The word "exemplary" is used herein in the meaning of "used as an illustration". Unless otherwise stated, any embodiment described herein as "exemplary" should not be construed as preferable or having an advantage over other embodiments.

Any positioning terminology, such as "left", "right", "top", "bottom", "above", "under", etc., may be used herein for convenience to describe one element's or feature's relationship to one or more other elements or features in accordance with the figures. It should be apparent that the positioning terminology is intended to encompass different orientations of the structure and device disclosed herein, in addition to the orientation(s) depicted in the figures. As an example, if one imaginatively rotates the apparatus in the FIGS. 90 degrees clockwise, elements or features described as "top" and "bottom" relative to other elements or features would then be oriented, respectively, "right" and "left" relative to the other elements or features. Therefore, the positioning terminology used herein should not be construed as any limitation of the present disclosure.

Furthermore, although the numerative terminology, such as "first", "second", etc., may be used herein to describe various embodiments, elements or features, these embodiments, elements or features should not be limited by this numerative terminology. This numerative terminology is used herein only to distinguish one embodiment, element or feature from another embodiment, element or feature. For example, a first embodiment discussed herein could be called a second embodiment, and vice versa, without departing from the teachings of the present disclosure.

The exemplary embodiments disclosed herein provide a technical solution that allows mitigating or even eliminating the drawbacks of the prior art which are mentioned in the description part "Background". In particular, the technical solution disclosed herein relates to an exercise device for incline push-ups that allows a user to do incline push-up exercises in a comfortable and efficient (in terms of the load exerted on upper body muscles) manner. More specifically, the exercise device comprises a push-up board removably attached to an edge of a worktop by using a support structure. When engaged with the edge of the worktop, the support structure is configured to support the board at an acute angle to the worktop. The exercise device thus configured may be particularly suitable for users who are in a recovery phase after a surgery or after an injury (e.g., a shoulder injury).

As used in the exemplary embodiments disclosed herein, a worktop may relate to a firm, flat, horizontal surface of a cabinet, counter, cooking table, etc. Given this, the worktop may be also referred to as a tabletop, countertop, benchtop, etc. It is also implied herein that the worktop has an overhanging edge on at least one side. Such an overhanging edge may have a different profile, such, for example, as a chamfer profile, a double chamfer profile, rounded profile, square profile, thumbnail profile, bullnose profile, cove profile, ogee profile, or any combination thereof.

Figure 1B:
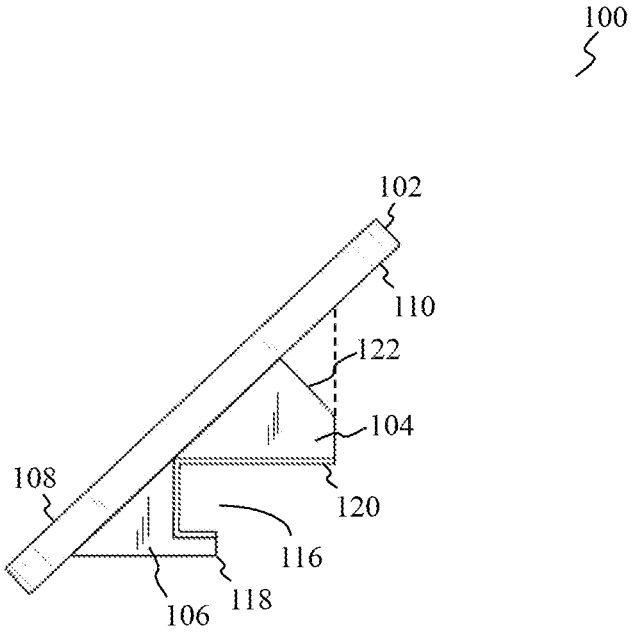
Figure 1C:
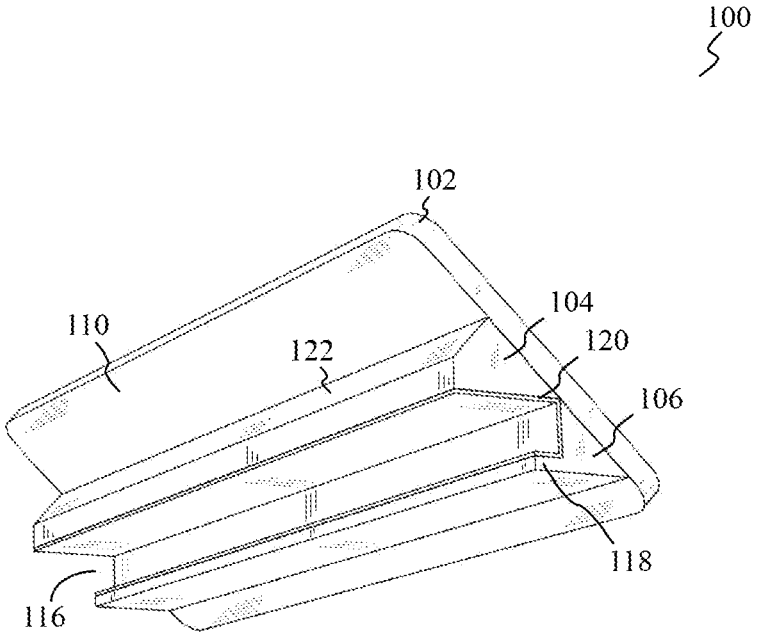

FIGS. 1A-1C show different views of an exercise device 100 for incline push-ups in accordance with a first exemplary embodiment. More specifically, FIG. 1A shows a front perspective view of the exercise device 100, FIG. 1B shows a side view of the exercise device 100, and FIG. 1C shows a bottom perspective view of the exercise device 100. As shown in FIGS. 1A-1C, the exercise device 100 comprises a board 102 and a support structure comprising a first (upper) support bracket 104 and a second (lower) support bracket 106. The board 102, the first support bracket 104 and the second support bracket 106 may be made of wood or plastic. Preferably, the board 102 may be 20-30 inches long, 8-10 inches wide, and 1-2 inches thick. Each of the first support bracket 104 and the second support bracket 106 may be implemented as a profiled bar having a length similar to that of the board 102.

Referring back to FIGS. 1A-1C, the board 102 has a top surface 108 and a bottom surface 110. The top surface 108 of the board 102 is intended for receiving one or both user hands (i.e., a user places his/her one or both hands on the top surface 108, depending on whether he/she wants to do incline push-ups with one or both hands) and may be coated with a foam cushion or any other suitable material that eases pressure on the user hands. As shown in FIG. 1A, the top surface 108 may additionally comprise hand position markings. In particular, there are two hand position markings formed on the top surface 108, with one represented by a pair of palm contours 112-1-112-2 and another represented by a pair of palm contours 114-1-114-2. The palm contours 112-1-112-2 correspond to the incline push-up exercise at which user hands are placed directly underneath user shoulders. The palm contours 114-1-114-2 correspond to the so-called diamond incline push-ups at which user index fingers and thumbs are positioned such that they are in touch, forming a diamond shape. Each of these two hand position markings may be used to develop certain upper body muscles (e.g., the diamond incline push-ups may activate chest muscles like the pectoralis major, shoulder muscles like the anterior deltoid). It would be apparent to those skilled in the art that the present disclosure is not limited to the hand position markings shown in FIG. 1A; in some other embodiments, any other hand position markings may be formed on the top surface 108 of the board 102. Moreover, in case of many (more than two) hand position markings, they may be color-coded so that the user can easily and quickly determine which of them to use at the moment (in this case, color coding information corresponding to different upper body muscles or, in other words, different incline push-up types may be additionally indicated, for example, in one corner of the top surface 108).

As also follows from FIGS. 1A-1C, the first support bracket 104 and the second support bracket 106 are shaped to form a through groove 116 when they are attached adjacent to each other on the bottom surface 110 of the board 102. More specifically, each of the first support bracket 104 and the second support bracket 106 has a cross-section in the form of a right triangle (see FIG. 1B), and the second support bracket 106 has a protruding section 118 that may be considered as a continuation of the bottom leg of the right triangle. The first support bracket 104 and the second support bracket 106 are attached to the bottom surface 110 of the board 102 such that the board 102 "rests on" the adjacent hypotenuses of both right triangles in the side view of FIG. 1B; in this arrangement of the first support bracket 104 and the second support bracket 106, only the protruding section 118 is under the first support bracket 104. Preferably, the protruding section 118 has such a length that the projection of the first support bracket 104 on a horizontal axis in the side view of FIG. 18 is only partly "blocked" by the projecting section 118. In general, the arrangement and configuration of the first support bracket 104 and the second support bracket 106 should be selected such that the through groove 116 formed by them corresponds to the shape of an edge of a worktop (not shown in FIGS. 1A-1C) which is to be engaged with the exercise device 100. The through groove 116 may be additionally coated (fully or partly) with a layer 120 of rubber material to improve the engagement between the exercise device 100 and the worktop edge. Furthermore, to reduce material consumption and total device dimensions in the unmounted state, the first support bracket 104 may be made with a truncated top, as viewed from the side view of FIG. 18 (in which the dashed line implies the initial top truncated by a plane extending, for example, along a surface 122).

It should be noted that the shape of the through groove 116 and the inclination angle of the board 102 relative to the edge of the worktop may be changed by replacing the removable support brackets 104 and 106 with any other support brackets selected depending on the profile of the edge of the worktop to be used for the incline push-up exercises. The first support bracket 104 and the second support bracket 106 are suitable for forming the square groove 116 corresponding to the square or bullnose edge of the worktop. For example, if it is required to engage the exercise device 100 with any other edge profile (e.g., the ogee profile), the user may replace the support brackets 104 and 106 with those forming, when attached adjacent to each other on the bottom surface 110, an ogee groove rather than the square groove 116. Thus, the configurations of the support brackets 104 and 106 are not limited to those shown in FIGS. 1A-1C.

In some other embodiments, instead of its division into the support brackets 104 and 106, the support structure may be implemented as an integral member removably attached to the bottom surface 110 of the board 102. In this case, the support structure may also be shaped differently depending on the edge of the worktop to be used for the incline push-up exercises.

Preferably, irrespective of whether the support structure is implemented as two individual support brackets (like the support brackets 104 and 106) or an integral member, there is a possibility for the user to change the angle at which the through groove (e.g., the through groove 116) runs to the board 102 within the range from about 30 to about 70 degrees by simply replacing the support structure with a new one.

Figure 2:
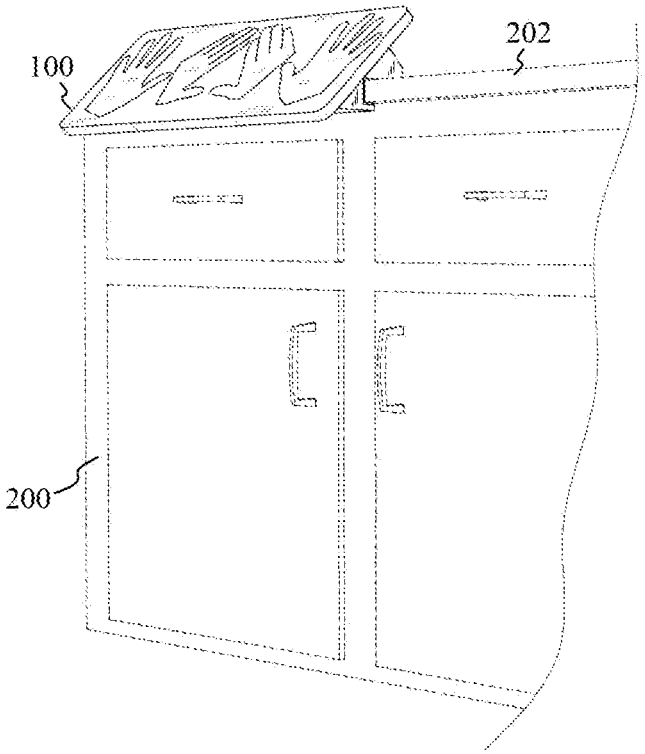
FIG. 2 shows a perspective view of the exercise device of FIGS. 1A-1C in engagement with an edge of a worktop.

FIG. 2 shows a perspective view of the exercise device 100 in engagement with a cabinet 200, i.e., an edge 202 of its worktop. As follows from FIG. 2, the edge 202 of the worktop may be an overhanging square edge on the front side of the cabinet 200.

Figure 3A:
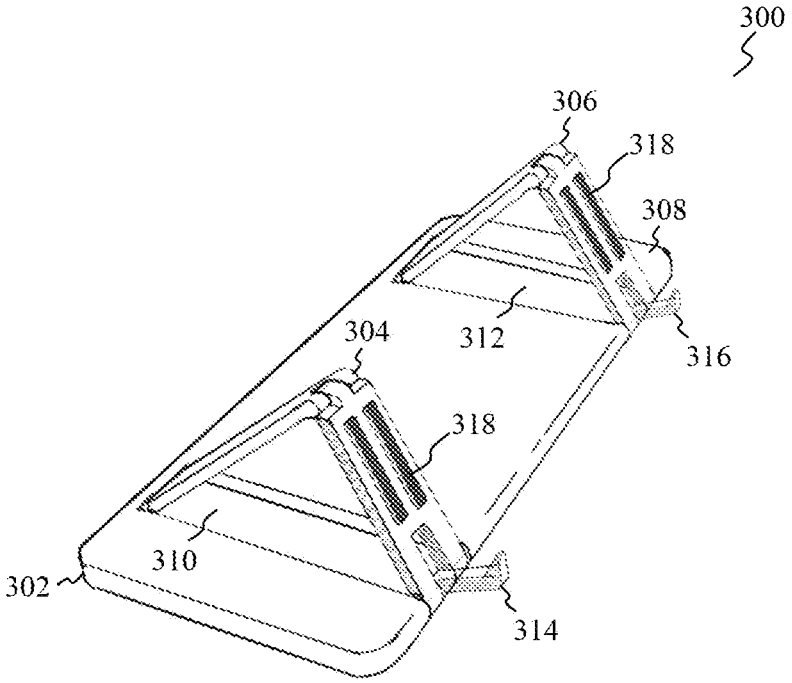
FIGS. 3A and 3B show a bottom perspective view of an exercise device for incline push-ups in an unfolded state (FIG. 3A) and a folded state (FIG. 3B) in accordance with a second exemplary embodiment.
Figure 3B:
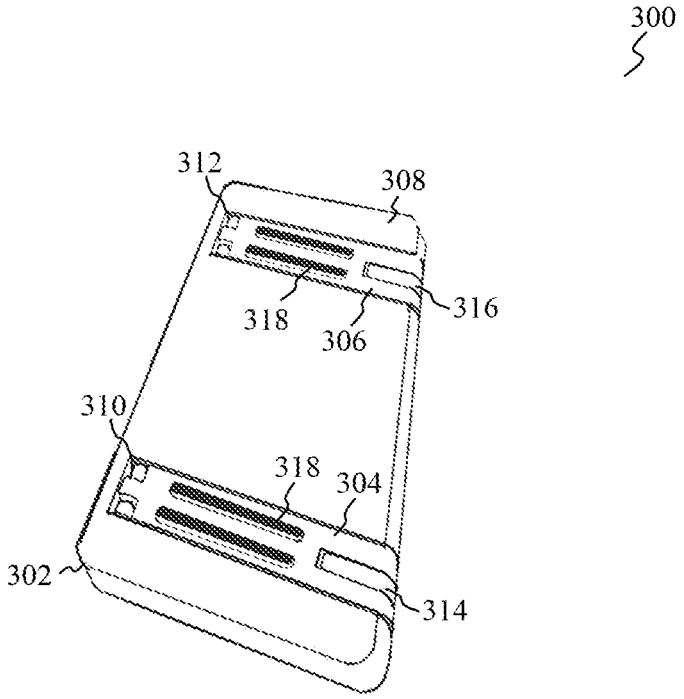

FIGS. 3A and 3B show a bottom perspective view of an exercise device 300 for incline push-ups in an unfolded state (FIG. 3A) and a folded state (FIG. 3B) in accordance with a second exemplary embodiment. As shown in FIGS. 3A and 3B, the exercise device 300 comprises a board 302 and a support structure configured to be engaged with an edge of a worktop (not shown in FIGS. 3A and 3B). The support structure comprises a first folding bracket 304 and a second folding bracket 306, each of which may be implemented as a wooden, metal or plastic hinged bracket. The board 302 has a top surface (not shown in FIGS. 3A and 3B) for receiving one or more user hands and a bottom surface 308. The board 302 may have the same dimensions as the board 102 and may be made of wood or plastic as well. Similar to the top surface 108, the top surface of the board 302 may be provided with one or more hand position markings, and/or coated with a foam cushion or any other suitable material that eases pressure on the user hands. The bottom surface 308 of the board 302 has a first recess 310 and a second recess 312. Each of the first and second folding brackets 304 and 306 is configured to be in the folded state and the unfolded state. The folding brackets 304 and 306 are attached to the bottom surface 308 of the board 302 such that they are hidden in the recesses 310 and 312, respectively, in the folded state (see FIG. 3B). It should be noted that the present disclosure is not limited to the number of the folding brackets (and, correspondingly, the number of the recesses) which are shown in FIGS. 3A and 3B. In one other embodiment, there may be a single folding bracket which is configured, when unfolded, to securely support the board 302 in the inclined position; correspondingly, the bottom surface 308 of the board 302 may have a single recess in which such a single folding bracket may be hidden in the folded position.

As also shown in FIGS. 3A and 3B, the first and second folding brackets 304 and 306 comprise movable clamping elements 314 and 316, respectively. The clamping elements 314 and 316 are configured to be engaged with the edge of the worktop when the first and second folding brackets are in the unfolded state. As can be seen in FIG. 3A, each of the clamping elements 314 and 316 has an L-like shape. However, the present disclosure is not limited to the L-shape of the clamping elements 314 and 316. Similar to the through groove 116, the clamping elements 314 and 316 may be shaped to match different worktop edge profiles.

In one embodiment, each of the first and second folding brackets 304 and 306 may have a layer 318 of rubber material at least partly covering that surface portion which is in contact with the edge of the worktop when the corresponding clamping element is engaged with the edge of the worktop. For example, the layer 318 of rubber material may be formed as one or more rubber strips.

Figure 4:
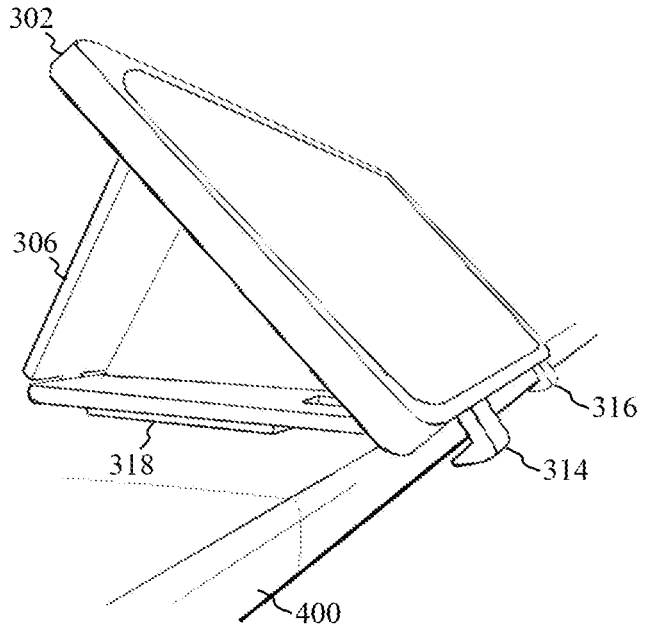
FIG. 4 shows a perspective view of the exercise device of FIGS. 3A and 3B in engagement with an edge of a worktop.

FIG. 4 shows a perspective view of the exercise device 300 in engagement with a cabinet, i.e., an edge 400 of its worktop. The edge 400 of the worktop may be an overhanging square edge on the front side of the cabinet.

In some other embodiments, the exercise device 100 or 300 may further comprise one or more sensors integrated in the board 102 or 302 and a display installed on the top surface 108 of the board 102 or the top surface of the board 302. The sensor(s) may be configured to collect push-up related information, such as a heart rate of the user during the incline push-up exercises, a number of incline push-ups done, calories burned during the incline push-up exercises, a pace of incline push-ups, or any combination thereof. The display may be connected to the sensor(s) and configured to output the push-up related information to the user.

In some other embodiments, the exercise device 100 or 300 may further comprise a processing unit installed in the board 102 or 302 and connected to the sensor(s). The processing unit may be configured to generate a plan for everyday incline push-up exercises based on the push-up related information from the sensor(s). This plan may be then outputted by the display or wirelessly transmitted by the processing unit to a user device (e.g., a mobile station, a mobile terminal, a mobile subscriber unit, a mobile phone, a cellular phone, a smart phone, a cordless phone, a personal digital assistant (PDA), a wireless communication device, a desktop computer, a laptop computer, a tablet computer, etc.). The processing unit may comprise a processor and a memory coupled to the processor. The memory may store processor-executable instructions which, when executed by the processor, cause the processor to perform the above-described operations.

The processor may be implemented as a CPU, general-purpose processor, single-purpose processor, microcontroller, microprocessor, application specific integrated circuit (ASIC), field programmable gate array (FPGA), digital signal processor (DSP), complex programmable logic device, etc. It should be also noted that the processor may be implemented as any combination of one or more of the aforesaid. As an example, the processor may be a combination of two or more microprocessors.

The memory may be implemented as a classical nonvolatile or volatile memory used in the modern electronic computing machines. As an example, the nonvolatile memory may include Read-Only Memory (ROM), ferroelectric Random-Access Memory (RAM), Programmable ROM (PROM), Electrically Erasable PROM (EEPROM), solid state drive (SSD), flash memory, magnetic disk storage (such as hard drives and magnetic tapes), optical disc storage (such as CD, DVD and Blu-ray discs), etc. As for the volatile memory, examples thereof include Dynamic RAM, Synchronous DRAM (SDRAM), Double Data Rate SDRAM (DDR SDRAM), Static RAM, etc.

The processor-executable instructions stored in the memory may be configured as a computer-executable program code which causes the processor to perform the aspects of the present disclosure. The computer-executable program code for carrying out operations or steps for the aspects of the present disclosure may be written in any combination of one or more programming languages, such as Java, C++, or the like. In some examples, the computer-executable program code may be in the form of a high-level language or in a pre-compiled form and be generated by an interpreter (also pre-stored in the memory) on the fly.

Figure 5:
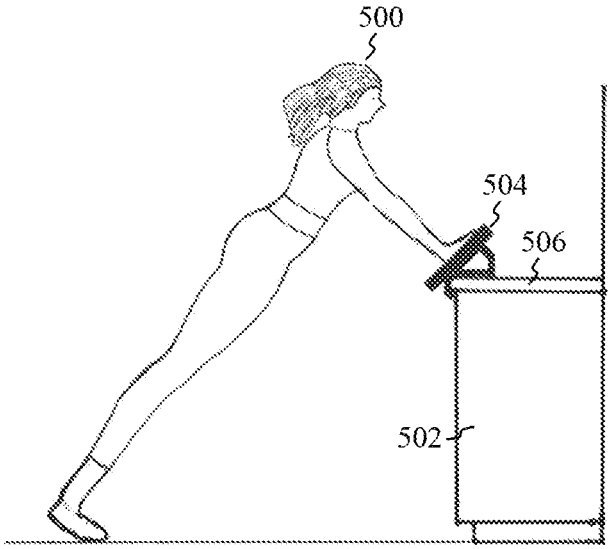
FIG. 5 schematically shows how a user may do incline push-ups by using a cabinet.

FIG. 5 schematically shows how a user 500 may do incline push-ups by using a cabinet 502. At first, the user 500 attaches an exercise device 504 to a front worktop edge 506 of the cabinet 502. The exercise device 504 may be implemented as the exercise device 100 or 300. In case of using the exercise device 100, it may be attached to the edge 506 of the cabinet 502 by inserting the edge 506 in the through groove 116. In case of using the exercise device 300, it may be attached to the edge 506 of the cabinet 502 by bringing the folding brackets 304 and 306 in the unfolded state and engaging the clamping elements 314 and 316 with the edge 506. Then, the user 500 may place her hands on the board 102 or 302 (e.g., according to a certain hand position marking, if available) and start doing the incline push-ups.

Although the exemplary embodiments of the present disclosure are described herein, it should be noted that any various changes and modifications could be made in the embodiments of the present disclosure, without departing from the scope of legal protection which is defined by the appended claims. In the appended claims, the word "comprising" does not exclude other elements, steps or operations, and the indefinite article "a" or "an" does not exclude a plurality. The mere fact that certain measures are recited in mutually different dependent claims does not indicate that a combination of these measures cannot be used to advantage.

What is claimed is:

1. An exercise device for incline push-ups, comprising:

a push-up board having a top surface and a bottom surface, the top surface being configured to receive at least one hand of a user; and a support structure attached to the bottom surface of the push-up board, wherein the support structure is configured to be engaged with an edge of a worktop, wherein the support structure is configured, when engaged with the edge of the worktop, to support the push-up board at an acute angle to the worktop, wherein the push-up board and the support structure are configured to withstand a pressure exerted by the user on the top surface of the push-up board during the incline push-ups, and wherein the top surface of the push-up board comprises at least one hand position marking.

2. The device of claim 1, wherein the support structure has a through groove that is shaped to match the edge of the worktop, and wherein the through groove runs relative to the push-up board such that the push-up board is at the acute angle to the worktop when the support structure is engaged with the edge of the worktop via the through groove.

3. The device of claim 2, wherein the support structure comprises a first support bracket and a second support bracket, and wherein the first support bracket and the second support bracket are shaped such that, when attached adjacent to each other on the bottom surface of the push-up board, the first support bracket and the second support bracket form the through groove.

4. The device of claim 3, wherein the through groove has an inner surface at least partly coated with a rubber material.

5. The device of claim 1, further comprising: at least one sensor integrated in the push-up board, the at least one sensor being configured to collect push-up related information; and a display installed on the top surface of the push-up board, the display being connected to the at least one sensor and configured to output the push-up related information to the user.

6. The device of claim 5, wherein the push-up related information comprises at least one of: a heart rate of the user during the incline push-ups; a number of incline push-ups done; calories burned during the incline push-ups; and an incline push-up pace.

7. The device of claim 6, further comprising a processing unit installed in the push-up board and connected to the at least one sensor, wherein the processing unit is configured to generate a plan for everyday incline push-up exercises based on the push-up related information from the at least one sensor.

8. The device of claim 1, wherein the push-up board has at least one recess made on the bottom surface, and wherein the support structure comprises at least one folding bracket configured to be in a folded state and an unfolded state, the at least one folding bracket being attached to the bottom surface of the push-up board such that the at least one folding bracket is hidden in the recess in the folded state, and the at least one folding bracket comprising a clamping element configured to be engaged with the edge of the worktop when the at least one folding bracket is in the unfolded state.

9. The device of claim 8, wherein each of the at least one folding bracket has a surface portion which is in contact with the edge of the worktop when the clamping element is engaged with the edge of the worktop, and wherein the surface portion is at least partly coated with a rubber material.

10. The device of claim 1, wherein the acute angle ranges from about 30 to about 70 degrees.

11. The device of claim 1, wherein the top surface of the push-up board is coated with a foam cushion.

12. The device of claim 1, wherein the top surface of the push-up board comprises at least two hand position markings each corresponding to a different hand position, each of the at least two hand position markings being color-coded.

13. The device of claim 1, wherein each of the push-up board and the support structure is made of wood or plastic.

14. The device of claim 1, wherein the top surface being configured to receive a palm of the at least one hand of the user.

* * * * *